US008899717B2

(12) United States Patent
Koehler et al.

(10) Patent No.: US 8,899,717 B2
(45) Date of Patent: Dec. 2, 2014

(54) PRINT SPEED DETERMINATION BASED ON A POWER BUDGET

(71) Applicant: Hewlett-Packard Development Company, L.P., Houston, TX (US)

(72) Inventors: Duane A. Koehler, Vancouver, WA (US); Mark H. MacKenzie, Vancouver, WA (US); Douglas Harriman, Portland, OR (US); Matthew A. Shepherd, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/755,479

(22) Filed: Jan. 31, 2013

(65) Prior Publication Data

US 2014/0210894 A1 Jul. 31, 2014

(51) Int. Cl.
*B41J 2/165* (2006.01)
*B41J 11/42* (2006.01)

(52) U.S. Cl.
CPC ..... *B41J 11/42* (2013.01)
USPC ..... 347/19

(58) Field of Classification Search
None
See application file for complete search history.

(56) References Cited

U.S. PATENT DOCUMENTS

| | | | | |
|---|---|---|---|---|
| 6,779,862 | B2 | 8/2004 | Elgee | |
| 7,260,336 | B2 | 8/2007 | Shimura et al. | |
| 7,817,290 | B2 | 10/2010 | Klassen et al. | |
| 2002/0135631 | A1 * | 9/2002 | Sasaki et al. | 347/19 |
| 2011/0164285 | A1 | 7/2011 | Itagaki | |
| 2012/0066522 | A1 | 3/2012 | Nakajima et al. | |

OTHER PUBLICATIONS

Chae et al., "A Study on the Characteristic of High Voltage Type Instantaneous Current Source for Laser Printer," 2004 35th Annual IEEE Power Electronics Specialists Conference, Aachen, Germany, 2004, pp. 2731-2735.

* cited by examiner

*Primary Examiner* — Alejandro Valencia

(57) ABSTRACT

A printing system including a print mechanism to print on a print medium; and a control unit coupled to the print mechanism. The control unit is to determine a page speed for the print medium based on a power budget value of a power supply and to cause the print mechanism to move the print medium through the printing system at the determined page speed.

18 Claims, 6 Drawing Sheets

PRINT SPEED DETERMINATION BASED ON A POWER BUDGET

BACKGROUND

Many printers have a power supply. The amount of power draw required by a printer depends on a number of factors such as the density of the image being printed (for example, a 3-line email requires less energy to print than a full page color photograph), the quality of the printing process (higher resolution versus lower resolution), and other factors. A power supply for a given printer has a specific rating (e.g., 180 watts) that defines the upper limit of its power delivery capacity. Each power supply has weight, occupies a volume, and generates heat, all of which may be problematic for a printer design.

BRIEF DESCRIPTION OF THE DRAWINGS

For a detailed description of various examples, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect, direct, optical or wireless electrical connection. Thus, if a first device couples to a second device, that connection may be through a direct connection or through an indirect connection via other devices and connections.

DETAILED DESCRIPTION

Often, a printer's power supply is rated for a worst case power demand scenario (highest print speed, highest quality printing, color, dense image, etc.). However, the printer often does not actually print at the worst case power demand scenario. In accordance with the principles described herein, a printing system includes a power supply that is rated lower than would otherwise be required for a worst case printing scenario. The printing system, instead, may adjust the print speed to ensure compliance with the power rating of the power supply. As such, many print jobs are permitted to print at the print speed nominally set for the print jobs, while the print speed for higher power draw print jobs may be forced to a lower print speed based on a power budget value (rating) of the printer's power supply. Forcing the print speed to a lower level prevents the printing system from exceeding the rating of its power supply and permits a smaller (lower power, lighter, smaller volume) power supply to be used instead. The implementation described herein permits the print speed to be varied from page-to-page and to be varied within a single page. The term "print speed" refers to the speed at which printed pages pass through the printer. Print speed may be measured in any suitable units such as pages per time (e.g., pages per minute) based on a particular page size (letter size, A4, etc.), linear distance per time (e.g., inches per second), etc.

Figure 1:
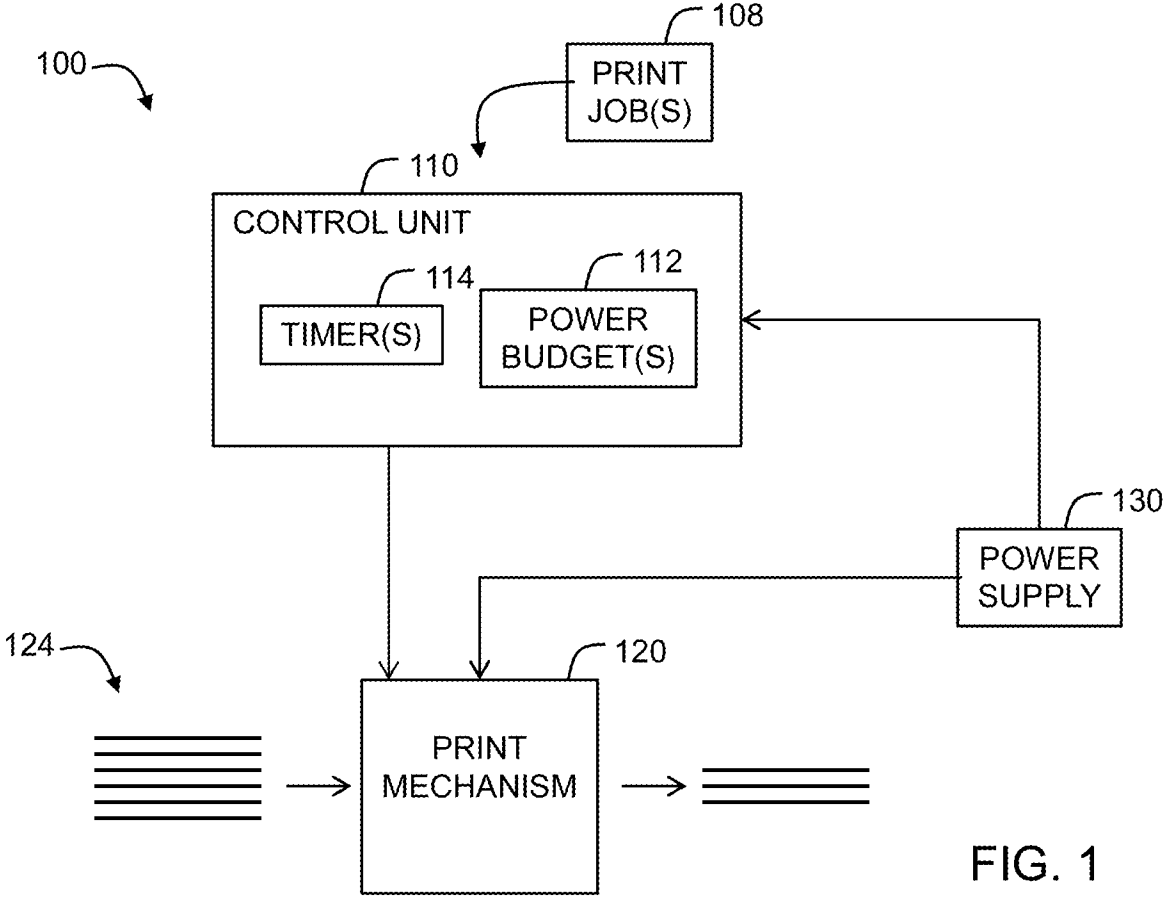
FIG. 1 shows a system in accordance with various examples.

FIG. 1 illustrates an example of a printing system 100 (also referred to as a "printer"). As shown, the printing system 100 includes a control unit 110 coupled to a print mechanism 120. The print mechanism 120 may include a page wide print array or other type of mechanism (e.g., a print head) to force a printing medium such as ink (e.g., black, cyan, magenta, yellow, etc.), powdered toner, melted wax ink, etc. onto print media 124. Print media 124 may be individual sheets of media or roll-based media and is pulled through the print mechanism 120 for printing.

One or more print jobs 108 are received into the control unit 110. The print jobs may be loaded via a network or provided on a storage device connected to the printing system 100. The print job to be printed may be provided in any of a variety of forms and file formats (e.g., Portable Document Format ("PDF"), Joint Photographic Experts Group ("JPEG"), etc.). The control unit 110 processes each print job to ensure compliance with one or more power ratings (termed "power budgets" herein) associated with a power supply 130. The power supply 130 provides electrical current to operate the control unit 110, print mechanism 120, and any other electrical devices in the printing system.

As noted above, the power supply 130 has one or more power budgets. In the example of Table I below, the power supply 130 has five power budgets based on different time frames

TABLE I

| 10 ms | 80 ms | 10 min | 30 min | Continuous |
|---|---|---|---|---|
| 180 watts | 150 watts | 125 watts | 100 watts | 80 watts |

The 10 millisecond (ms) time frame is associated with a power budget of 180 watts. This means that the power supply 130 is rated to supply 180 watts of power over a 10 ms time window on average. For an 80 ms time window, the power supply is rated to supply 150 watts. As the time frames increase, the power supply power budget may decrease. For a 10 minute time frame, the power supply in the example of Table I is rated for 125 watts, while over a 30 minute time frame, the power supply is rated for 100 watts. Finally, the power supply is rated at 80 watts continuously. The control logic 110 ensures compliance with all of these power budgets. The various power budget values for the power supply may be stored in non-volatile storage in, or accessible to, the control unit and is shown in FIG. 1 as power budgets 112.

There may be multiple sources of energy draw in a printing system. For example, one or more motors are included in the printing system to drive the print media 124 through the print mechanism 120. Further, for inkjet-based printing, each drop of ink fired onto the print media requires a finite amount of energy which is a readily known or is a determinable quantity.

Thus, given a page of a print job to be printed, the amount of energy required to fire all of the drops of ink comprising the image on that page can be calculated. Generally, the energy required to fire the ink drops for a given page is the product of the energy per dot times the number of dots on the page. The amount of energy to fire a given drop of ink may vary based on the color of the ink (e.g., a black drop of ink may require a different amount of energy for firing than a cyan/magenta/yellow drop of ink).

Each page of a print job 108 may be analyzed by the control unit 110 to determine the energy required to print that page. In some implementations, the control unit 110 counts the number of drops of ink to be printed for a given page and multiplies that number by the energy required to fire each drop of ink. If different colors require different amounts of energy, then the control unit may compute the amount of energy required for each such color. Further, the control unit 110 may analyze a portion of a page to determine the energy requirement for that particular portion. In some implementations, the resolution for the intra-page energy assessment is $1/600^{th}$ of an inch, but may be other than $1/600^{th}$ of an inch in other implementations. That is, the control unit 110 may determine the energy required to print as little as $1/600^{th}$ of an inch of a page of print media.

Figure 2:
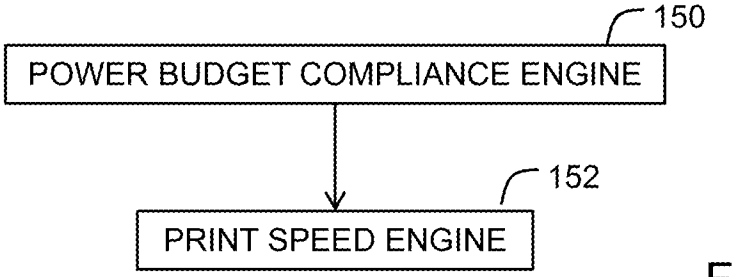
FIG. 2 shows a system in accordance with various examples.

FIG. 2 shows an implementation of control unit 110. The implementation shown in FIG. 2 includes a power budget compliance engine 150 and a print speed engine 152. The power budget compliance engine 150 ensures compliance by the printing system 100 of the various power budgets of the power supply 130, and the print speed engine 152 sets the print speed accordingly. The print speed engine 152 may force the print speed to a lower level based on a determination by the power budget compliance engine 150 that a power budget of the power supply 130 would otherwise be exceeded.

Figure 3:
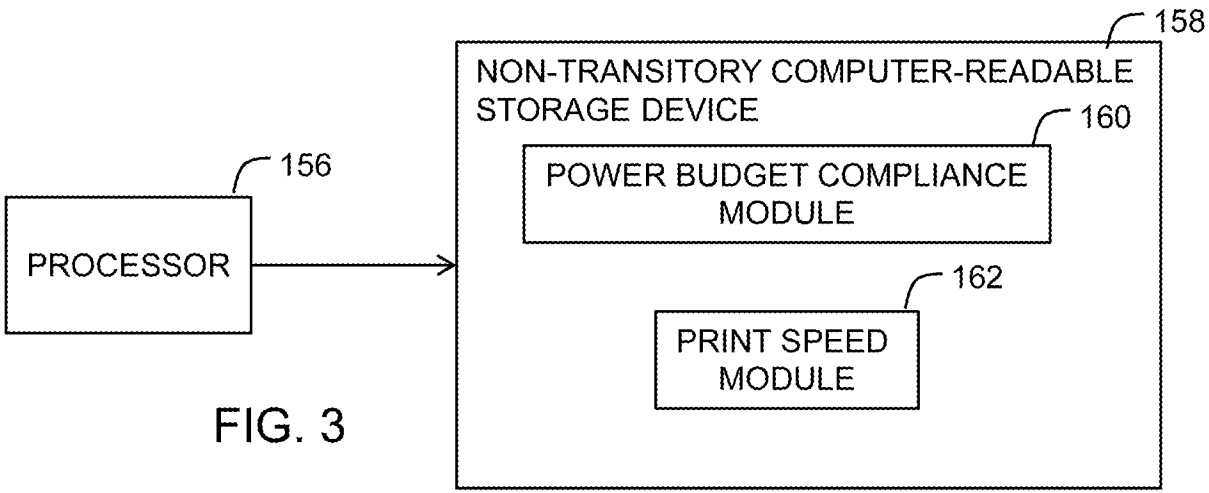
FIG. 3 shows the system in accordance with yet other examples.

FIG. 3 shows another implementation of the control unit 110 as comprising a processor 156 coupled to a non-transitory, computer-readable storage device 158. The storage device 158 may include volatile storage (e.g., random access memory), non-volatile storage (e.g., hard drive, optical disc, Flash storage, etc.) or combinations thereof. The storage device 158 may include one or more executable software modules. The example of FIG. 3 includes a power budget compliance module 160 and a print speed module 162. Both modules are executable by processor 156. Although two separate executable modules are shown in FIG. 3, in other implementations, the functionality performed by the modules may be embodied in a single integrated module. The engines 150, 152 of FIG. 2 are implemented as the processor 156 executing the corresponding module 160, 162. That is, the power budget compliance engine 150 includes the processor 156 executing the power budget compliance module 160, and the print speed engine includes the processor 156 executing the print speed module 162. By themselves, the modules 160-162 are incapable of performing a function, and thus are executed by the processor 156 to perform the functionality described herein.

Figure 4:
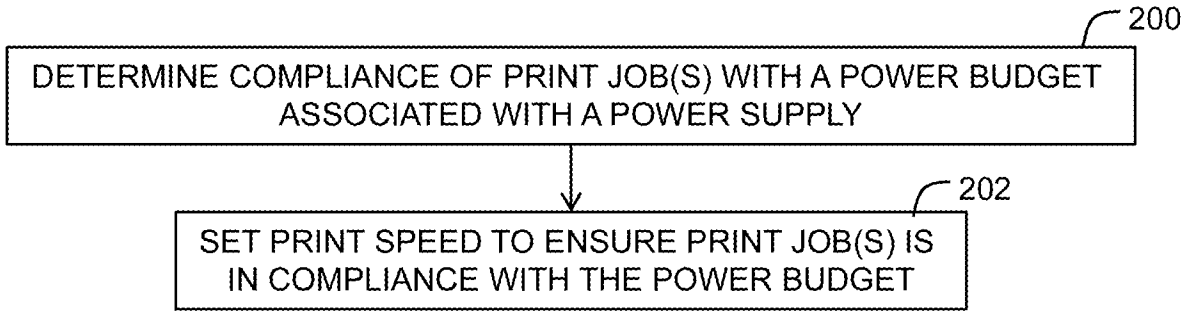
FIG. 4 illustrates a method in accordance with various examples.

FIG. 4 illustrates a method in accordance with an example. The method comprises determining (200) compliance of one or more print jobs with a power budget associated with a power supply. This operation may be performed by the power budget compliance engine 150. The method also includes setting (202) a print speed to ensure compliance of the print job with the power budget. Operation 202 may be performed by the print speed engine 152.

Figure 5:
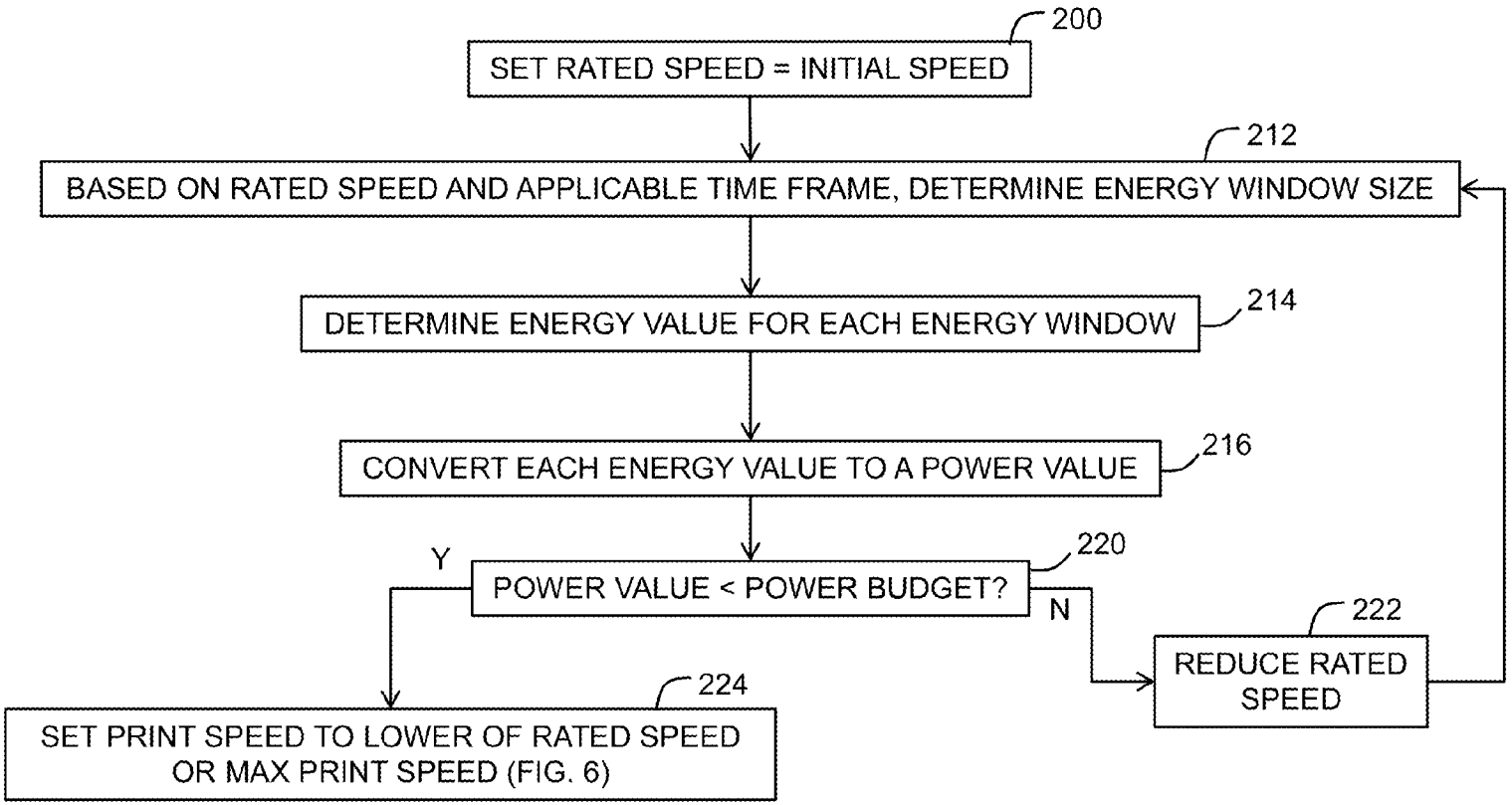
FIG. 5 illustrates another method in accordance with various examples.
Figure 6:
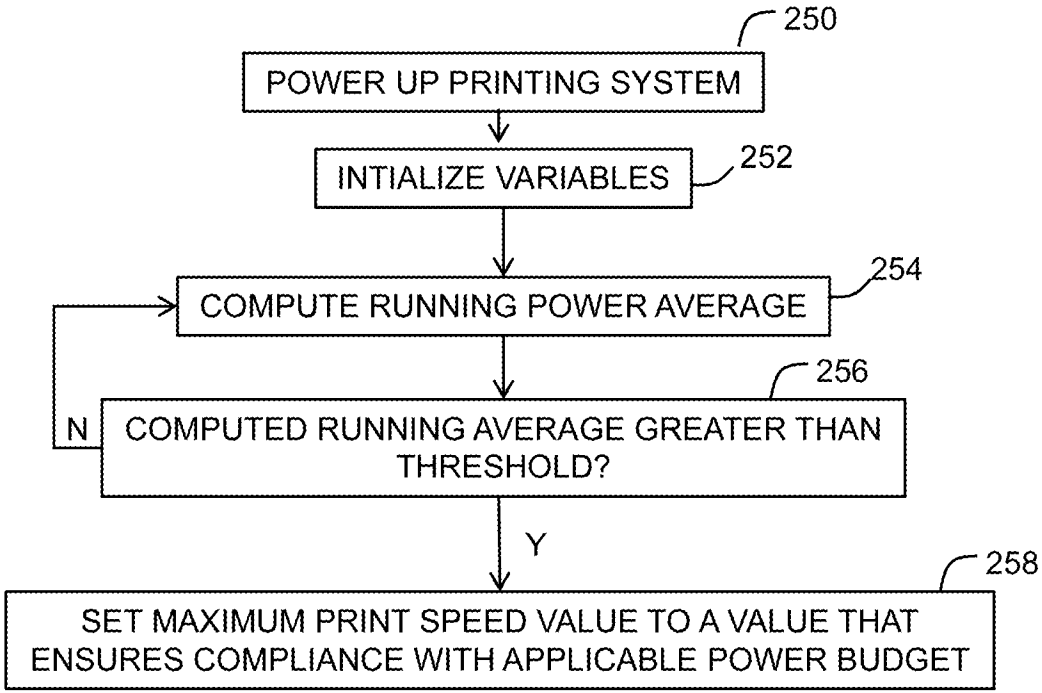
FIG. 6 illustrates another method in accordance with various examples.

FIGS. 5 and 6 provide additional detail to the operations shown in FIG. 4. The method of FIG. 5 is directed to the processing of print job by power budget compliance engine 150 on a scale of less than a page, whereas FIG. 6 is directed to processing the print job on a multi-page time frame. With reference to Table I, the 10 ms and 80 ms time frames are time frames commensurate with printing less than a full page, while the 10 minute, 30 minute and continuous time frames are time frames consistent with printing across multiple pages.

The printing system 100 may not have sufficient internal storage to store an entire print job (or multiple print jobs) to be printed over a longer period of time. The amount of storage may be sufficient to only print a few pages at a time. Before a given page is printed, the budget compliance and print speed determinations can be performed prior to printing the page as that particular page is already stored in the internal storage of the printing system. As such, before each page is printed, the control logic 110 of the printing system determines whether the page can be printed at a print speed specified by the print job, or whether a portion or all of that page should be printed at a lower print speed to avoid exceeding the power budget of the intra-page time frames (e.g., 10 ms and 80 ms).

It may not be possible to determine power budget compliance and print speed for the longer time frames (e.g., 10 minutes, 30 minutes, continuous) before beginning to print such corresponding pages of the print job (e.g., before printing 10 minutes worth of print job which may include 200 pages) because the internal storage of the printing system may not be sufficiently large to hold those pages. Thus, in some implementations and as will be explained below, the inter-page print speed determination is performed during the printing process and is based on keeping track of actual power expenditure. Of course, if the printing system 100 did have enough internal storage to store an entire print job of numerous pages (e.g., 10 minutes or 30 minutes worth of printing), then the method of FIG. 5 may be performed for such longer portions as well.

Referring to FIG. 5, the operations shown represent a method that may be performed for each of the various shorter time frames associated with the power supply's various power budgets (i.e., time frames for which the pages to be printed can be fully stored in the printing system's storage). The method of FIG. 5 first may be applied for the smallest intra-page time frame (e.g., 10 ms time frame of the example of Table I). The method subsequently may be performed for increasingly greater intra-page time frame(s) (e.g., the 80 ms time of Table I). Operations 210-222 may be performed by the power budget compliance engine 150, while operation 224 may be performed by the print speed engine 152.

At 210 the method includes setting a "rated speed" variable to an initial print speed. The initial speed may be dictated by parameters inherent in the print job or may be the computed print speed from a prior performance of the method for a shorter time frame. For the example of Table I, the method is performed first for the 10 ms time frame and the initial speed may be a maximum speed determined from the print job itself. In some implementations, the initial print speed may be set by some other physical limitation of the printer. Limiting factors may include maximum rate at which print nozzles can fire ink, maximum rate at which print data can be processed by the digital electronics of the printer, maximum at which liquid ink can be transported to the print nozzles, etc. If the method of FIG. 5 for the 10 ms time frame results in a print speed lower than the initial print speed, then the rated speed set at 210 for the next iteration of the method for the next time frame (80 ms) may be set at the lower print speed resulting from the 10 ms-based processing.

Figure 7:
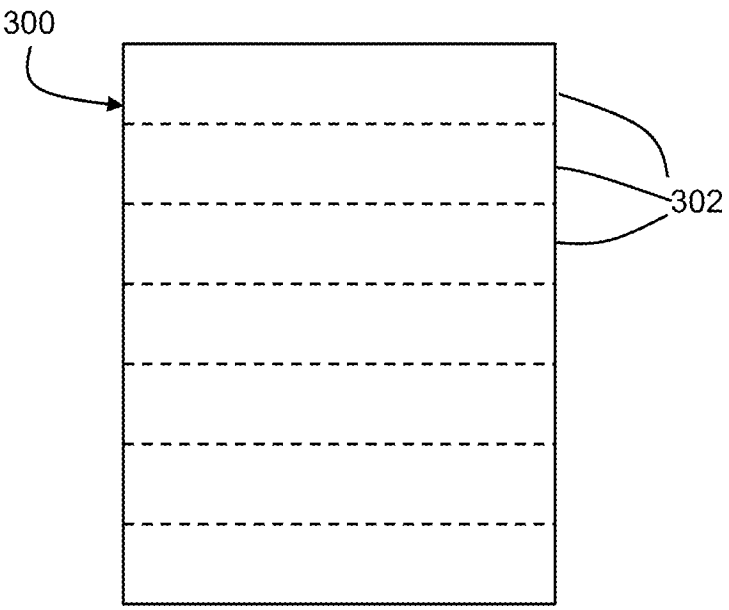
FIG. 7 shows a single page of a print job divided into multiple energy windows in accordance with various examples.

At 212, a size of an energy time window is determined based on the rated speed from 210. The energy time window size may be based on physical properties and behaviors of various circuit components in the particular design implementation of the power supply 130. For instance, the 10 ms window may represent short-term overheating of a switching transformer that is caused by transformer saturation due to high load current over multiple consecutive switching cycles. As such these energy time windows may be unique to a particular power supply design and may be determined based upon the design parameters of the power supply circuitry. The energy time windows permit a power expenditure at the time scale commensurate with the applicable time frame (10 ms, 80 ms) to be determined. FIG. 7 illustrates a single page 300 of print media divided logically into multiple energy windows 302. A portion of the page is printed in each energy window and the amount of energy required to print the content of each window can be determined. However, it should be noted that each page is not necessarily broken into sections for printing; instead each size energy windows moves down the page and the worst case calculation for the window over the entire page may be used as the print speed. If a time window is, for example, 10 ms, approximately 0.15 inches of a page are printed for a print speed of 15 inches per second (ips). At 15 IPS, the 10 ms energy window would be 0.15 inches wide (or 90/600 inches). The average of the first 90/600ths is calculated. The window is then shifted $1/600^{th}$ of an inch and recalculated. This process repeats down the page. For a given energy window, there may be no drops of ink to be printed, while other energy windows may have a varying number of drops of ink to be printed. Thus, the amount of energy to print in a given energy window can vary widely. The amount of energy required to print for a given energy window is determinable from the print job.

At 214, the method further includes determining an energy value for each energy window based on the print job. At 216, the method includes converting each energy value to a power value. This conversion may be performed by dividing each energy value by the corresponding time period over which the energy was determined (i.e., the time size of the corresponding energy window).

If, as determined at 220, the power value is greater than the power budget, then at 222, the rated speed value is reduced. In some implementations, the initially set rated speed is a maximum print speed value and is reduced by a lowest resolution increment with each pass through operations 212-222. For example, printing system 100 may be capable of a maximum print speed of 20 IPS with 1 IPS increments (e.g., 1 IPS, 2 IPS, . . . , 20 IPS). Each rated peed reduction at 222 therefore is reduced by 1 IPS.

After the rated speed value is reduced at 222, control loops back to operation 212 and operations 212-220 are again performed to determine power budget compliance. The method thus may be iterative, with each iteration resulting in a reduction of the rated speed value until the power value is less than the corresponding power budget.

In other implementations, the rated speed to test through each pass through operations 212-222 is based on a binary search algorithm. The initial rated speed from the example above may be 20 IPS. If that speed is determined to be exceed the power budget at 220, the rated speed is cut in half (10 IPS) with that reduced value being tested through the operations 212-222. If 10 IPS proves still to be too fast, then the rated speed is reduced to 5 IPS which then is tested. On the other hand, if 10 IPS proves not to result in a power budge violation, then it may be that a slightly higher speed would also work (e.g., 11-19 IPS). In that case, the rated speed of 10 IPS may be increased to 15 IPS (halfway between an acceptable 10 IPS and an unacceptable 20 IPS). This binary search process may continue until settling on a rated speed.

Other techniques for selecting print speeds to test through operations 212-222 are possible as well. For example, the process for selecting a print speed not be iterative. For example, if the initial print speed is 20 IPS and, based on that speed, the power value is computed (e.g., 300 watts) to be greater than the applicable power budget (e.g., 150 watts at 80 ms), then the print speed is computed to be 20 IPS*150 W/300 W=10 IPS.

Once the power value is determined to be less than the applicable power budget, control continues at 224 by setting the print speed to be the lower of the rated speed value and the maximum print speed determined from the process of FIG. 6 (described below). Thus, operation 224 selects the print speed to be the lower of the print speed determined based on an analysis of content to be printed before actually printing the content and a maximum print speed set based on a running power average computed during printing (see FIG. 6).

As additional pages of the print job are stored in the internal storage of the printing system (e.g., storage device 158), each page is processed for power budget compliance and print speed determination as explained above.

In some implementations, a print speed is determined for each energy window (no averaging across energy windows) and the lowest speed determined for the energy windows of a given page is used to print the entire page. In other implementations, the print speed can be varied from energy window to energy window using the process of FIG. 5.

Referring now to FIG. 6, an illustrative method is shown for setting a maximum print speed based on actual power consumption assessed during printing. The maximum print speed determined in FIG. 6 is then used in the method of FIG. 5 when analyzing each page before beginning to print it. The operations illustrated in FIG. 6 may be performed by the power budget compliance engine 150. The print speed set in the method of FIG. 6 is determined during an actual printing process, that is, while a print job is currently printing. The calculation is largely based on power required over multiple pages of printing. As printing begins, at 250 the printing system is powered up and variables are initialized at 252. Such variables may include variables used to compute a running power average and may include a sample rate, a default print speed, a unit of time over which the running average is to be computed, etc. Because a running average is determined, a timer is used. FIG. 1 shows that the control unit 110 includes one or more timers 114. Each timer is used to keep track of time to be used in computing power. Each inter-page time frame (e.g., 10 minutes, 30 minutes, etc.) may have a separate timer.

At 254, a running power average is computed over a corresponding time period. For example, for the 10 minute power budget, a 10 minute running average is computed. The running average may be updated at any desired interval (e.g., once every 100 ms). At each such interval, the running average is computed by taking a new sample (the power expended by the printing system since the last interval, such as energy expended since last interval divided by the time interval) and averaging that new sample together with the previous n such samples (n may be the number of such samples that span the time corresponding to the power budget (e.g., 10 minutes).

At 258, the running power average from 256 is compared to a threshold. The threshold may be the power budget applicable to the corresponding time frame or may be a scaled version of that power budget (e.g., 90 of the power budget).

At 258, if the computed power value is less than the threshold, the control unit determines that printing at the current print speed(s) will not violate the applicable inter-page power budget and control loops back to operation 254 to repeat the process for an updated running power average. On the other hand, if the computed power value is greater than the threshold, the method sets a maximum print speed at a low enough level that ensures compliance with the applicable power budget. That maximum print speed is used as a "cap" in the intra-page calculations of the method of FIG. 5.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A printing system, comprising:

a print mechanism to print on a print medium; and a control unit coupled to the print mechanism, the control unit to:

determine, for each of a plurality of power supply power budgets, each power budget having a different size energy window, an enemy value for the energy window of that particular power supply power budget;

convert each energy value to a calculated power value;

determine a print speed for the print medium based on a comparison of the calculated power value for each power budget to a corresponding power supply power budget value; and cause the print mechanism to move the print medium through the printing system at the determined print speed.

2. The printing system of claim 1 wherein the control unit determines an energy value for each of multiple energy windows for a particular power supply power budget.

3. The printing system of claim 2 wherein the control unit converts the energy value for each energy window to a power value.

4. The printing system of claim 3 wherein the control unit reduces a print speed based on at least one of the power values being greater than the power budget value.

5. The printing system of claim 1 wherein, for each of a plurality of power budget values, the control unit determines compliance of a print job with each such power budget value and sets a print speed to a level that ensures compliance with all such power budget values.

6. The printing system of claim 1 wherein the control logic is to compute a running power average during printing.

7. The printing system of claim 6 wherein the running average is computed over a time period corresponding to printing of multiple pages.

8. The printing system of claim 6 wherein the control logic is to compare the computed running power average to a threshold and to set a maximum print speed scale based on the comparison.

9. The printing system of claim 8 wherein the control logic selects a print speed to be a lower of the maximum print speed and a print speed determined based on an analysis of content to be printed before actually printing the content.

10. A method, comprising:

determining compliance of a print job with a power budget associated with a power supply by determining an energy value required for printing each of a plurality of energy windows and converting each energy value to a power value; and setting a print speed based on whether the print job is in compliance with the power budget.

11. The method of claim 10 wherein setting the print speed comprises selecting a print speed to be a lower of a maximum print speed set based on a running average of power consumption during printing and a print speed determined based on an analysis of content to be printed before actually printing the content.

12. The method of claim 10 wherein determining compliance of the print job comprises computing a running power average during printing.

13. The method of claim 12 further comprising comparing the computed running power average to a threshold and setting a maximum print speed based on the comparison.

14. A non-transitory, computer-readable storage device comprising software that, when executed by a processor, causes the processor to:

determine compliance of a print job with a power budget associated with a power supply by determining an energy value required for printing each of a plurality of energy windows and converting each energy value to a power value; and set a print speed based on whether the print job is in compliance with the power budget.

15. The non-transitory, computer-readable storage device of claim 14 wherein the software causes the processor to determine the compliance of the print job with a power budget by:

computing multiple average power values, each average power value computed across multiple energy windows;

determining a maximum of the average power values; and comparing the maximum average power value to the power budget.

16. The non-transitory, computer-readable storage device of claim 15 wherein the software causes the processor to determine compliance of the print job with the power budget by further computing a running power average while printing and comparing the running power average to a threshold.

17. The non-transitory, computer-readable storage device of claim 15 wherein the software causes the processor to vary the print speed within a given page of print media.

18. The non-transitory, computer-readable storage device of claim 15 wherein the software causes the processor to determine compliance of the print job with multiple power budgets associated with the power supply, each power budget corresponding to a different period of time.

* * * * *

UNITED STATES PATENT AND TRADEMARK OFFICE

CERTIFICATE OF CORRECTION

PATENT NO. : 8,899,717 B2
APPLICATION NO. : 13/755479
DATED : January 27, 2015
INVENTOR(S) : Duane A. Koehler et al.

It is certified that error appears in the above-identified patent and that said Letters Patent is hereby corrected as shown below:

In the Claims

In column 7, line 22, in Claim 1, delete “enemy” and insert -- energy --, therefor.

Signed and Sealed this
Fifteenth Day of December, 2015

Michelle K. Lee

Michelle K. Lee
*Director of the United States Patent and Trademark Office*